US005339650A

United States Patent [19]

Hakamada et al.

[11] Patent Number: 5,339,650

[45] Date of Patent: Aug. 23, 1994

[54] CRYOSTAT

[75] Inventors: Ryuichi Hakamada; Masahiko Takahashi; Toru Kuriyama, all of Kanagawa; Hideki Nakagome, Tokyo, all of Japan

[73] Assignee: Kabushiki Kaisha Toshiba, Kawasaki, Japan

[21] Appl. No.: 998,915

[22] Filed: Dec. 30, 1992

[30] Foreign Application Priority Data

Jan. 7, 1992 [JP] Japan ..... 4-000858

[51] Int. Cl.[5] ..... F25B 19/00

[52] U.S. Cl. ..... 62/51.1; 62/47.1; 62/48.2

[58] Field of Search ..... 62/47.1, 48.2, 51.1

[56] References Cited

U.S. PATENT DOCUMENTS 3,108,447 10/1963 Maher et al. ..... 62/47.1
3,538,714 11/1970 Kling et al. ..... 62/47.1
3,705,498 12/1972 DeHaan ..... 62/47.1
4,277,949 7/1981 Longsworth ..... 62/47.1
4,543,794 10/1985 Matsutani et al. ..... 62/47.1
4,790,147 12/1988 Kuriyama et al. ..... 62/47.1

OTHER PUBLICATIONS

Schwall, "MRI-Superconductivity in the Marketplace", IEEE Transactions on Magnetics, vol. Mag-23, No. 2, Mar. 1987.

*Primary Examiner*—Ronald C. Capossela
*Attorney, Agent, or Firm*—Foley & Lardner

[57] ABSTRACT

A cryostat housing an ultra-low temperature medium includes a container for storing the ultra-low temperature medium, a pipe for communication between the inner and outer sections of the container, at least one tubular member interposedly arranged inside the pipe between the pipe and an opening, a heat anchor section for cooling the pipe, and a plate-shaped member positioned so that a gas layer of the ultra-low temperature medium inside the tubular member divides the tubular member longitudinally.

28 Claims, 12 Drawing Sheets

CRYOSTAT

BACKGROUND OF THE INVENTION

1. Field of the Invention

The present invention relates to a cryostat with a pipe which connects a liquid gas storage tank for liquid helium or the like to a normal temperature section.

2. Description of the Prior Art

A magnetic resonance imaging (MRI) device which uses a superconducting magnet for generating a static magnetic field utilizes a cryostat provided with a liquid gas storage tank for liquid helium or the like.

FIG.10 is a schematic cross-sectional view of a conventional cryostat. As shown in the drawing, a first stage radiation shield plate 2 and a second stage radiation shield plate 3 are arranged in a vacuum tank 1, and a GM (Gifford-McMahon) refrigerator unit 4 is connected to the radiation shield plates 2, 3.

A liquid helium tank 6 for storing liquid helium 5 is positioned inside the second stage radiation shield plate 3, and a superconductive magnet 7 is positioned so that it is immersed in the liquid helium 5 in the liquid helium tank 6. A pipe 8 which passes through the vacuum tank 1 and the first and second stage radiation shield plates 2, 3 to communicate with a helium recovery section (omitted from the drawing) of a normal temperature section, is connected to the liquid helium tank 6. The pipe 8 is cooled at a first stage anchor section 9 and a second stage anchor section 10 of the first and second stage radiation shield plates 2, 3 (for example, to about 40K to 45K at the first stage anchor section 9 and to about 5K to 9K at the second stage anchor section 10).

In addition, in order to avoid the penetration of heat into the liquid helium tank 6 through the pipe 8 from the helium recovery section (omitted from the drawing) of the normal temperature section as the result of convection, heat conduction, and radiation of the helium gas, a cylindrical member 12 made from fiber reinforced plastic (FRP) with a plurality of baffle plates 11 installed in the peripheral direction on the outer peripheral surface is inserted into the pipe 8, as shown, for example, in FIG. 11, or, an FRP rod 14 with a plurality of baffle plates 11 installed in the peripheral direction is inserted into the pipe 8, in place of the cylindrical member 12, as shown in FIG. 12.

In this manner, in the above-mentioned conventional cryostat, the cylindrical member 12 with a plurality of baffle plates 11 installed in the peripheral direction on the outer peripheral surface (see FIG. 11), or the FRP rod 14 with a plurality of baffle plates 11 installed in the peripheral direction (see FIG. 12), is inserted in the pipe 8 connecting the liquid helium tank 6 with the helium recovery section (omitted from the drawing).

As a result, in the case where these, the cylindrical member 12 and the FRP rod 14, are not inserted into the pipe 8, the amount of heat penetrating from the helium recovery section (omitted from the drawing) through the pipe 8 to the liquid helium tank 6 which is about 19 mW (at a temperature of the second stage anchor section of about 7K), can be dropped to about 9 mW (at a temperature of the second stage anchor section of about 7K).

With the above-mentioned conventional cryostat, the cylindrical member 12 with a plurality of baffle plates 11 installed in the peripheral direction on the outer peripheral surface (see FIG. 11) or the FRP rod 14 with a plurality of baffle plates 11 installed in the peripheral direction (see FIG. 12) is inserted into the pipe 8 to reduce the amount of heat penetrating from the normal temperature section of the helium recovery section (omitted from the drawing) to the ultra-low temperature section of the liquid helium tank 6.

However, with the above-mentioned type of conventional cryostat, the convection of the helium gas to the liquid helium tank 6 from the helium recovery section (omitted from the drawing) is an unregulated flow because the baffle plates 11 are positioned in multiple stages in the pipe 8.

It is therefore not possible to adequately cut off the convection to the liquid helium tank 6 from the helium recovery section (omitted from the drawing).

For this reason, the liquid helium 5 evaporates from the liquid helium tank 6, giving rise to the necessity of replenishing the liquid helium frequently. Maintenance costs are therefore high.

SUMMARY OF THE INVENTION

Accordingly, an object of the present invention is to provide, with due consideration to the drawbacks of such conventional devices, a cryostat wherein the amount of heat penetration through the pipe from the normal temperature section to the liquid gas storage tank is greatly reduced so that the amount of the liquid helium evaporated is small.

According to one aspect of the present invention, there is provided a cryostat housing an ultra-low temperature medium, comprising:

- a container for storing the ultra-low temperature medium;
- a pipe for communication between the inner and outer sections of the container;
- at least one tubular member interposedly arranged inside the pipe between the pipe and an opening;
- a heat anchor section for cooling the pipe; and
- a plate-shaped member positioned so that a gas layer of the ultra-low temperature medium inside the tubular member divides the tubular member longitudinally.

According to another aspect of the present invention, there is provided a cryostat housing an ultra-low temperature medium, comprising:

- a container for storing the ultra-low temperature medium;
- a pipe for communication between the inner and outer sections of the container;
- a first and a second heat anchor section provided separated in the longitudinal direction of the pipe for cooling the pipe; and
- substantially one plate-shaped member placed in a position between the first and the second heat anchor sections so that a gas layer in the ultra-low temperature medium is divided in the pipe longitudinally.

According to still another aspect of the present invention, there is provided a cryostat housing an ultra-low temperature medium, comprising:

- a container for storing the ultra-low temperature medium;
- a pipe for communication between the inner and outer sections of the container;
- a heat anchor section for cooling the pipe; and
- a plate-shaped member formed from multilayers of insulating material positioned so that a gas layer of the ultra-low temperature medium inside the tubular member divides the tubular member longitudinally.

These and other objects, features, and advantages of the present invention will become more apparent from the following description of the preferred embodiment taken in conjunction with the accompanying drawings, in which:

DETAILED DESCRIPTION OF THE PREFERRED EMBODIMENTS

Principle of the Invention

Figure 1:
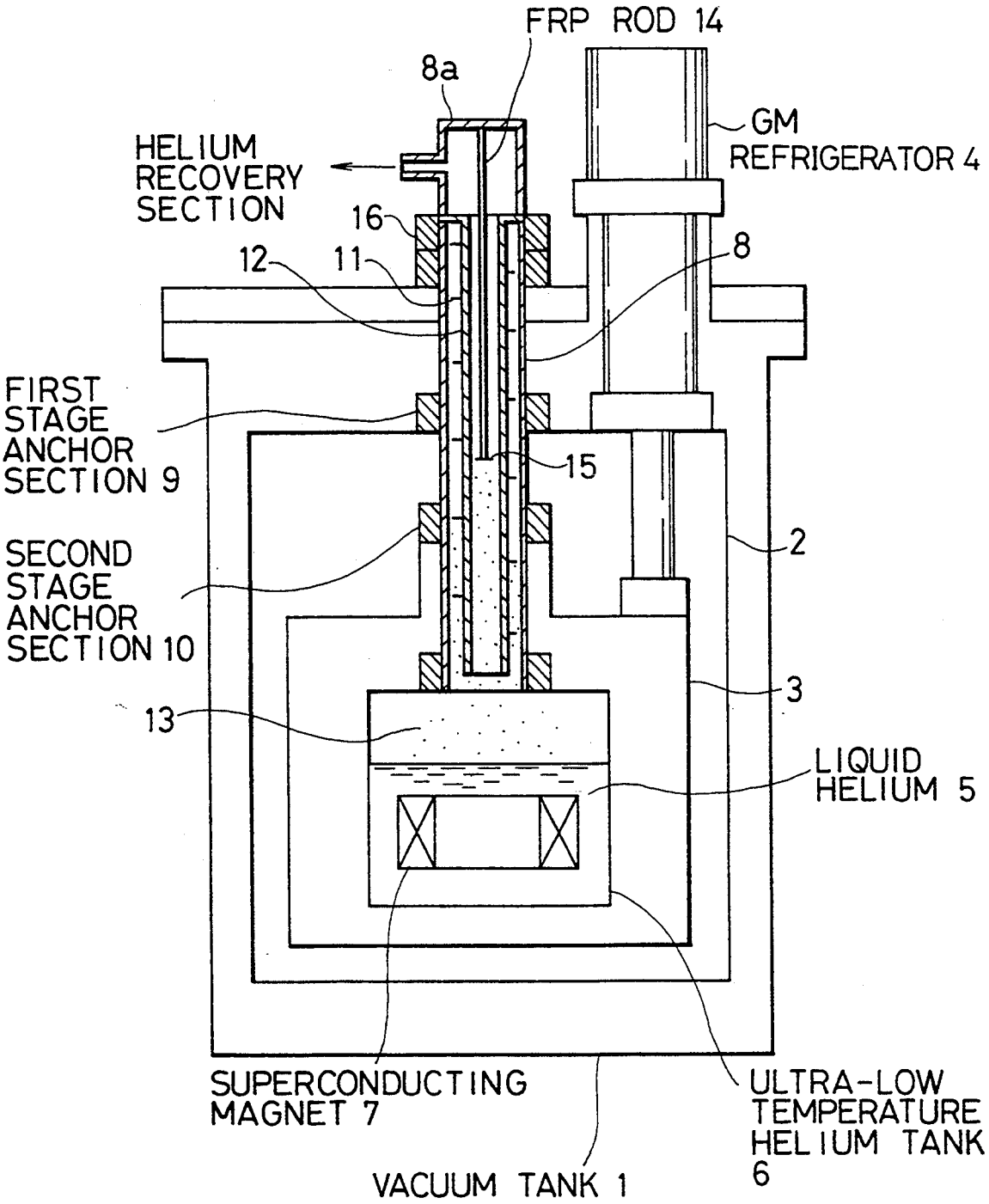
FIG. 1 is a schematic cross-sectional view showing a first embodiment of a cryostat of the present invention.

The inventor of the present invention, as the result of an accumulation of painstaking research into the problem of the penetration of heat to the liquid gas storage tank, has discovered that it is possible to regulate the temperature distribution of the vaporized gas in the pipe by inserting a baffle plate at a position point between a first anchor section and a second anchor section, or inserting an insertion plate formed from a member with a small heat radiation ratio, in a cryostat equipped with a pipe connecting a normal temperature section and a liquid gas storage tank as an ultra-low temperature section, and with a heat anchor section.

As a result, convection of the gas is prevented, and, in addition, radiation of heat from a normal temperature section is cut off. As a result, it is possible to reduce the amount of heat penetrating to a pipe with which a liquid gas storage tank is connected to a normal temperature section as an ultra-low temperature section.

In this manner, with the cryostat of the present invention it is possible to reduce the amount of heat penetrating to the liquid gas storage tank by means of an insertion plate provided at a specified position inside the pipe.

Embodiments

The features of this invention will become apparent in the course of the following description of exemplary embodiments which are given for illustration of the invention and are not intended to be limiting thereof.

The present invention is now explained in detail, based on drawings of embodiments of the present invention.

Parts identical or corresponding to the parts of a conventional device are designated by like reference numerals.

First Embodiment

Figure 2:
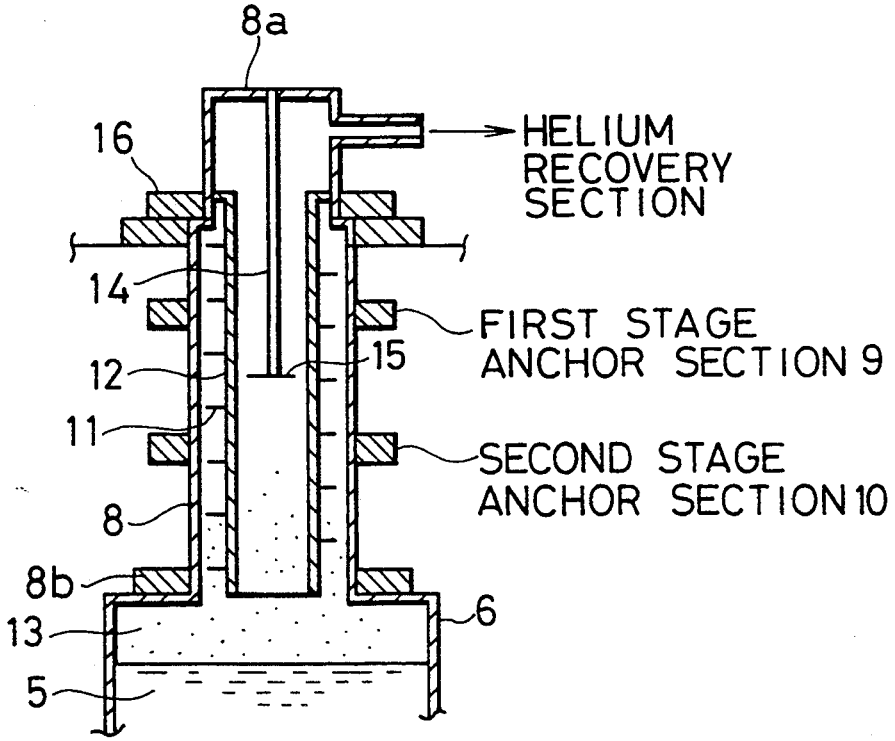
FIG. 2 is a schematic cross-sectional view showing a pipe of the first embodiment of the cryostat shown in FIG. 1.

FIG. 1 is a schematic cross-sectional view showing a first embodiment of a cryostat of the present invention. FIG. 2 is a schematic cross-sectional view showing a pipe 8 contained in this cryostat. As illustrated in these drawings, the cryostat of the present invention comprises a first stage radiation shield plate 2, a second stage radiation shield plate 3, an ultra-low temperature section in the form of a liquid helium tank 6 provided inside the second stage radiation shield plate 3, and a pipe 8 connecting the liquid helium tank 6 with a helium recovery section (omitted from the drawing), which acts as a normal temperature section, all contained in a vacuum tank 1, and is cooled by a GM refrigerator unit 4 connected to the first stage and the second stage radiation shield plates 2, 3.

A superconducting magnet 7 is positioned in the liquid helium tank 6 in which liquid helium 5 is stored and is immersed in the liquid helium 5. The pipe 8 is cooled at a first stage anchor section 9 and a second stage anchor section 10 of the first and second stage radiation shield plates 2, 3 (for example, to about 40K to 45K at the first stage anchor section 9 and to about 5K to 9K at the second stage anchor section 10). A cylinder member 12, fabricated from FRP, on the external surface of which a plurality of baffle plates 11 is installed in the peripheral direction, is inserted into the pipe 8.

An FRP rod 14, on the front end of which is installed a thin, circular insertion plate 15 fabricated from a thin plate of, for example, FRP with a low heat radiation coefficient, or MLI (multi-laminated insulating material), or stainless steel, or aluminum, or the like, as one sheet or a plurality of laminated sheets, is inserted into the cylinder member 12. (See FIG. 2). The insertion plate 15 is positioned at a location intermediate to the first anchor section 9 and the second anchor section 10, and a small gap of about 1 mm is formed between the peripheral surface of the insertion plate 15 and the inner peripheral surface of the cylinder member 12.

The upper section of the FRP rod 14 is secured to the inside of an upper section **8*a* of the pipe 8 which projects From the vacuum tank 1. The upper section 8*a* of the pipe 8 is connected in a freely detachable manner to a flange 16 positioned on the upper section of the vacuum tank 1 to engage the pipe 8. Also, the upper section of the cylinder member 12 is secured to the inner peripheral surface of the pipe 8**.

Figure 3:
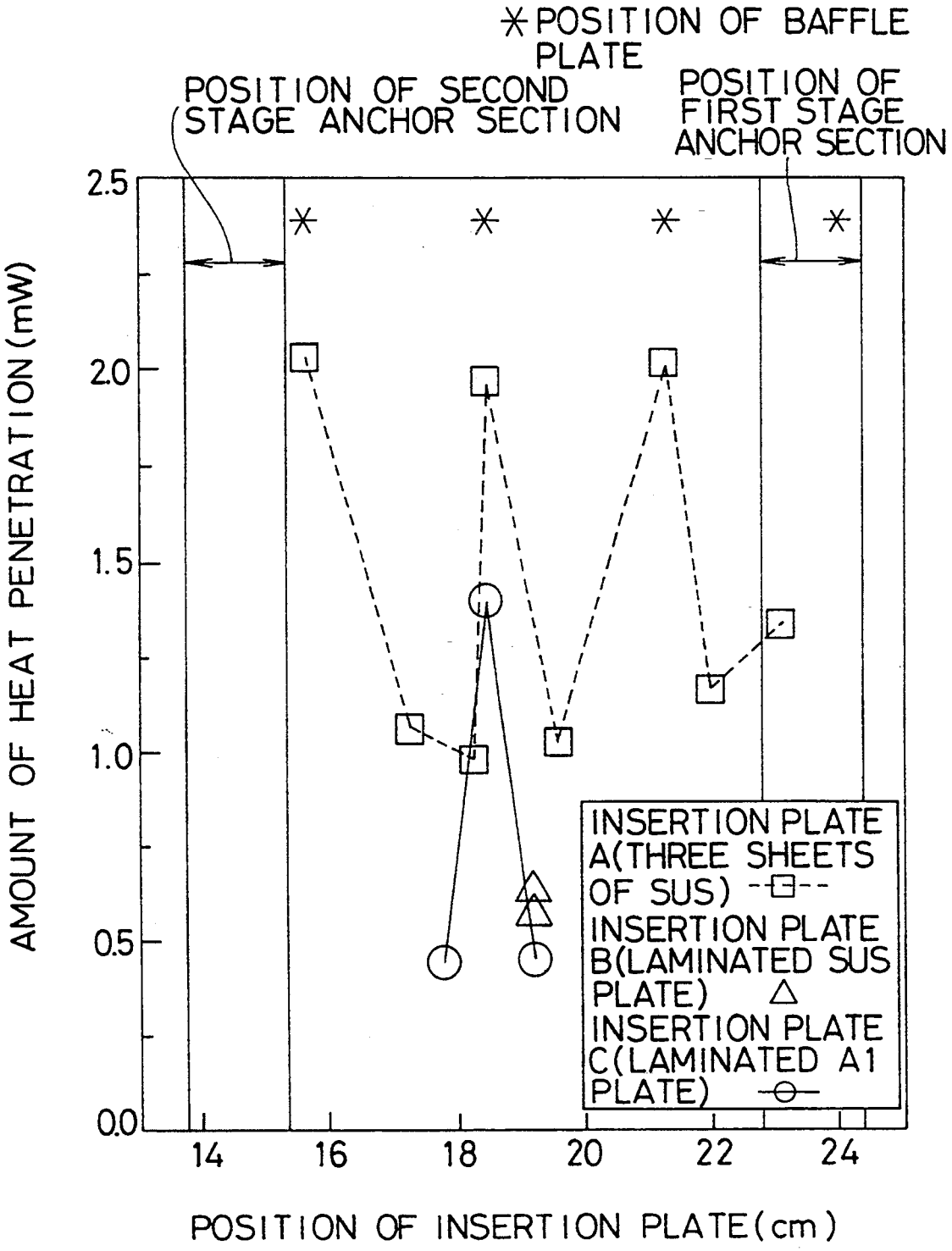
FIG. 3 is a graph showing the relationship between the position of the insertion plate and the heat penetration in the cryostat shown in FIG. 2.

FIG. 3 is a graph showing the relationship between the position of the insertion plate and the heat penetration in the cryostat shown in FIG. 2. The actual results are shown here for the cases of an insertion plate A fabricated from three stainless steel plates, an insertion plate B fabricated from a plurality of laminated stainless steel plates, and an insertion plate C fabricated from a plurality of laminated aluminum plates.

The position of the insertion plate (cm) indicates the distance of the insertion plate 15 measured from a surface 8*b* contacting the cylinder member 12 and the ultra-low temperature liquid helium tank 6.

As clearly shown in the drawing, the position at which the amount of heat penetration is at a minimum is a point approximately intermediate between the first stage anchor section and the second stage anchor section for all three types of insertion plates.

From these actual experimental results, it can be understood that when the insertion plate 15 is positioned in a position approximately intermediate between the first stage anchor section 9 and the second stage anchor section 10 the amount of heat penetration can be lowest.

Also, added to the conditions described above, as clearly shown in FIG. 3, the amount of heat penetration can be lowest when the insertion plate 15 is set in a position which is not the same positions of the baffle plates 11 (indicated by the symbol "*" in FIG. 8), namely when the baffle plates 11 formed on the cylinder member 12 viewed from the longitudinal direction of the cylinder member 12 are set at a position offset from the position of the insertion plate 15, it is possible to further reduce the amount of heat penetration.

Second Embodiment

Figure 4:
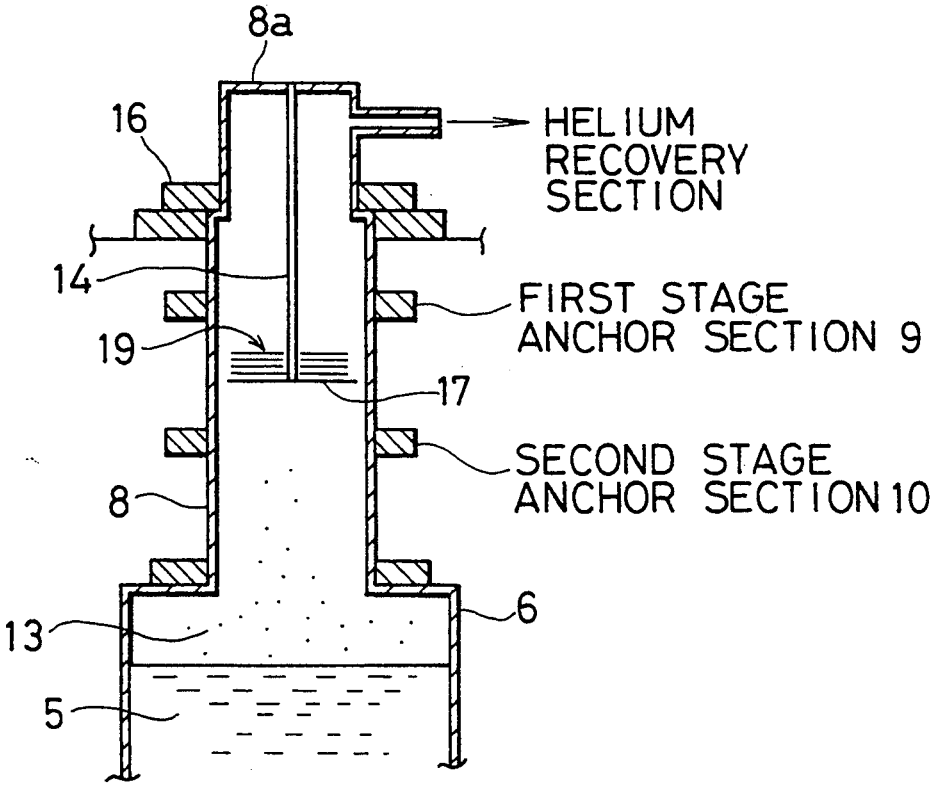
FIG. 4 is a schematic cross-sectional view showing a pipe of a second embodiment of the cryostat of the present invention.

FIG. 4 is a schematic cross-sectional view showing a pipe connected between the helium recovery section and the liquid helium tank in a second embodiment of the cryostat of the present invention.

In this embodiment, an insertion plate 19 formed by mounting a plurality of layers (for example, ten or more layers) of an MLI (multi-laminated insulating material) 18 with a low heat radiation coefficient on a circular FRP plate 17 is inserted into the pipe 8.

The insertion plate 19 is installed on the front end of the FRP rod 14 which is secured to the inside of the upper section 8*a* of the pipe 8. The insertion plate 19 is set in a position approximately intermediate between the first stage anchor section 9 and the second stage anchor section 10 like the first embodiment.

A small gap of about 1 mm is formed between the peripheral surface of the insertion plate 19 and the inner peripheral surface of the pipe 8. The configuration of the other parts is the same as in the first embodiment illustrated in FIG. 1 and FIG. 2.

Third Embodiment

Figure 5:
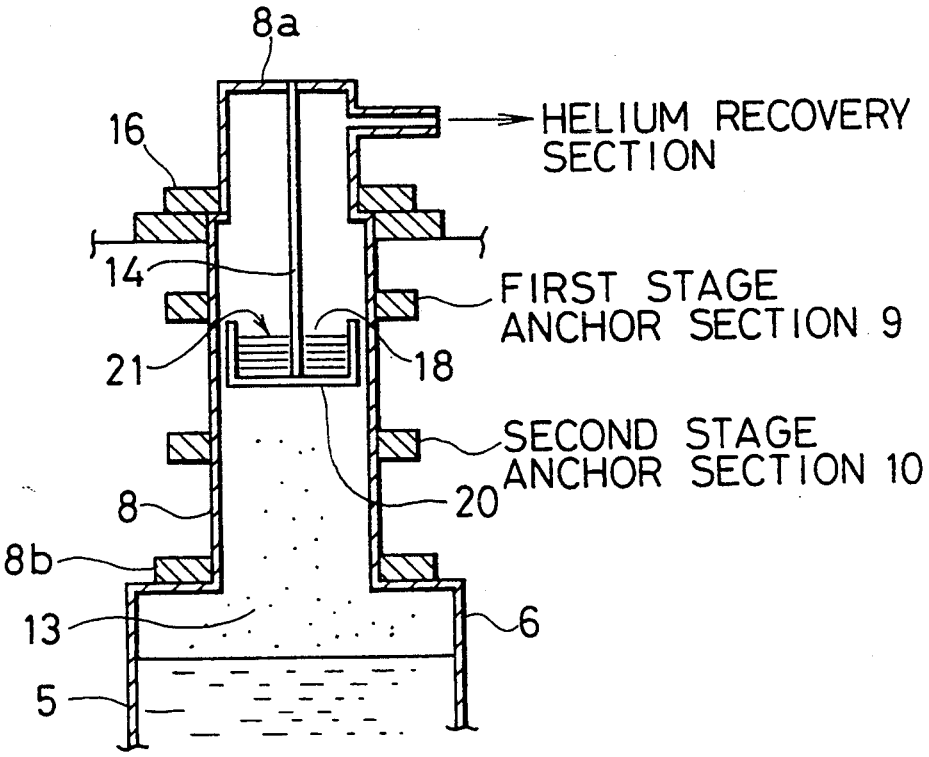
FIG. 5 is a schematic cross-sectional view showing a pipe of a third embodiment of the cryostat of the present invention.

FIG. 5 is a schematic cross-sectional view showing a pipe connected between the helium recovery section and the liquid helium tank in a third embodiment of the cryostat of the present invention.

In this embodiment, an insertion plate 21 formed by enclosing a plurality of layers (for example, ten or more layers) of the MLI (multi-laminated insulating material) 18 with a low heat radiation coefficient in a basket-shaped FRP vessel 20 is inserted into the pipe 8, and the insertion plate 21 is installed on the front end of the FRP rod 14 which is secured to the inside of the upper section 8*a* of the pipe 8.

The insertion plate 21 is positioned at a point intermediate to the first stage anchor section 9 and the second stage anchor section 10 of the previous embodiments. A small gap of about 1 mm is formed between the peripheral surface of the insertion plate 21 and the inner peripheral surface of the pipe 8.

The configuration of the other parts is the same as for the cryostat of the first embodiment illustrated in FIG. 1.

Figure 6:
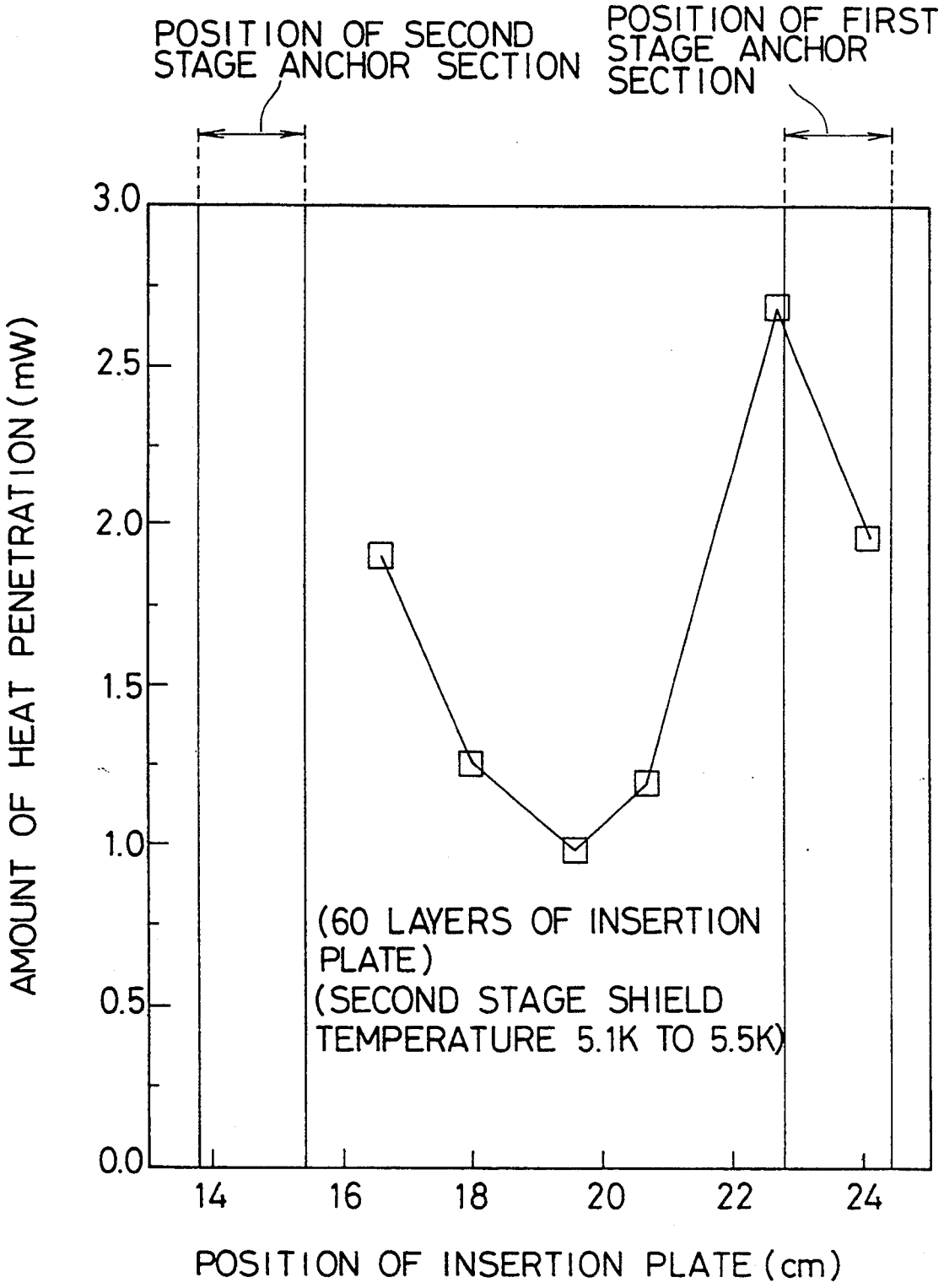
FIG. 6 is a view showing the relationship between the position of an insertion plate and the heat penetration in the cryostat shown in FIG. 5.

FIG. 6 is a view showing the relationship between the position of the insertion plate 21, formed in 60 lamination, and the heat penetration in the cryostat shown in FIG. 5.

In the drawing, in the same manner as for the case of the actual results shown in FIG. 3, the position of the insertion plate (cm) is the distance of the insertion plate 15 measured from a surface 8*b* contacting the cylinder member 12 and the ultra-low temperature liquid helium tank 6.

In the results for this embodiment also, in the same manner as for the case of the actual results shown in FIG. 3, it is clearly seen that the position of the insertion plate 21 at which the amount of heat penetration is at a minimum is a point approximately intermediate between the first stage anchor section and the second stage anchor section.

Fourth Embodiment

Figure 7:
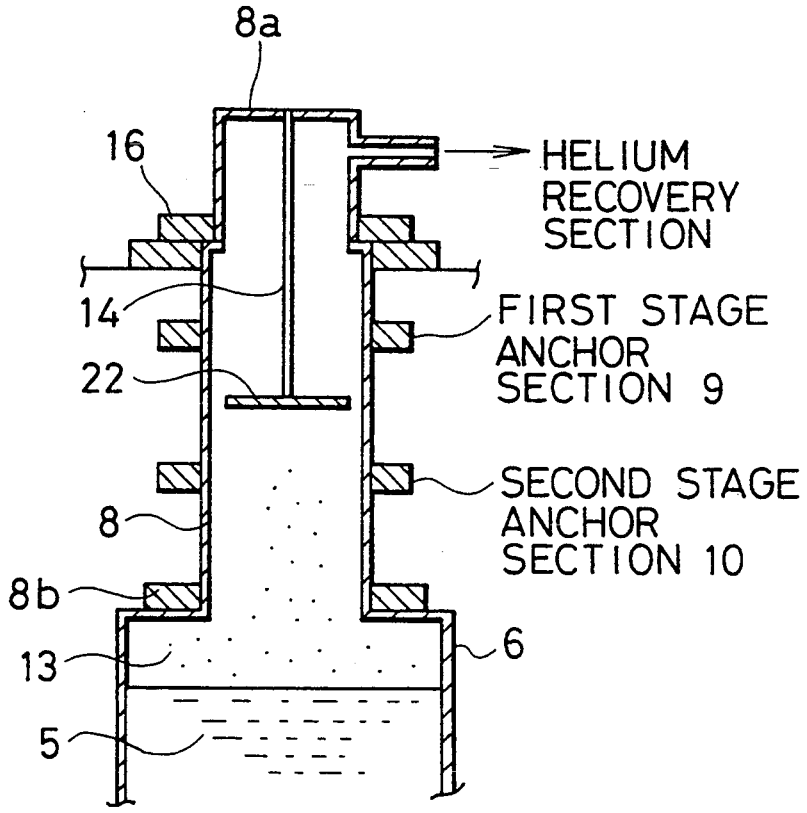
FIG. 7 is a schematic cross-sectional view showing a pipe of a fourth embodiment of the cryostat of the present invention.

FIG. 7 is a schematic cross-sectional view showing a pipe connected between the helium recovery section and the liquid helium tank in a fourth embodiment of the cryostat of the present invention.

In this embodiment, a thin, circular insertion plate 22 fabricated from a thin plate of, for example, FRP with a low heat radiation coefficient, or stainless steel, or aluminum, or the like, as one sheet or a plurality of laminated sheets, is inserted into the pipe 8. The insertion plate 22 is installed on the front end of the FRP rod 14 which is secured to the inside of the upper section 8*a* of the pipe 8.

The insertion plate 22 is positioned at a point intermediate to the first stage anchor section 9 and the second stage anchor section 10 in the same manner as in the previous embodiments. A small gap of about 1 mm is formed between the peripheral surface of the insertion plate 22 and the inner peripheral surface of the pipe 8.

The configuration of the other parts is the same as for the cryostat of the first embodiment illustrated in FIG. 1.

As shown in the first to fourth embodiments, by means of the insertion plates 15, 19, 21, 22 inserted so as to divide a layer of vaporized helium gas in the pipe 8 connected between the helium recovery section (omitted from the drawing) and the liquid helium tank 6 in the vertical direction (along the length of the pipe 8) at a point approximately intermediate between the first stage anchor section and the second stage anchor section it is possible to eliminate any deviation in the distribution of the temperature of the helium gas in the pipe 8, thus preventing convection in the helium gas. It is also possible to cut off heat radiation from the helium recovery section (omitted from the drawing) to the liquid helium tank 6.

Also, in the first to fourth embodiments, the FRP rod 14 installed on the front end of the insertion plates 15, 19, 21, 22 is secured to the upper section 8*a* of the pipe 8 installed in a freely detachable manner to the flange 16. Therefore, when the superconducting magnet 7 is initially excited into the superconductive state, the upper section 8*a* of the pipe 8 is first removed, a current lead (omitted from the drawing) is inserted into the pipe 8, and the superconducting magnet 7 is magnetized and enters the superconductive state.

Then, after the current lead (omitted from the drawing) is removed, the upper section 8*a* of the pipe 8 is reinstalled in the flange 16 and the insertion plates 15, 19, 21, 22 are inserted into the pipe 8. When the current lead (omitted from the drawing) is to be inserted or removed, the insertion plates 15, 19, 21, 22 are easily removed from the pipe 8 because the upper section 8*a* of the pipe 8 can be removed in the above-mentioned manner from the insertion plates 15, 19, 21, 22 which are integrally secured to the FRP flange 14.

Figure 8:
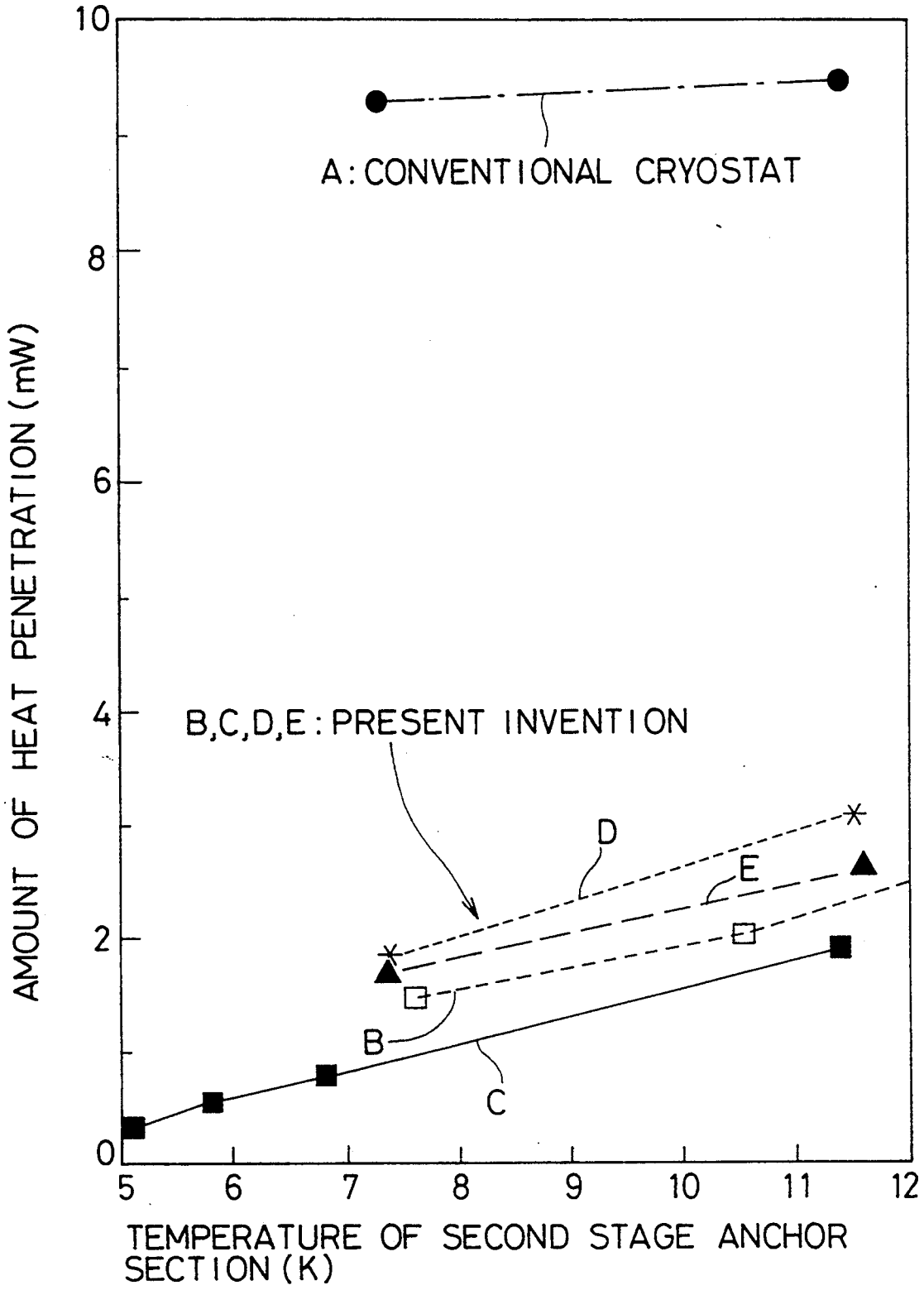
FIG. 8 is a graph showing the measured results of the amount of heat penetration to a liquid helium tank of a conventional cryostat and of each embodiment of the present invention.
Figure 10:
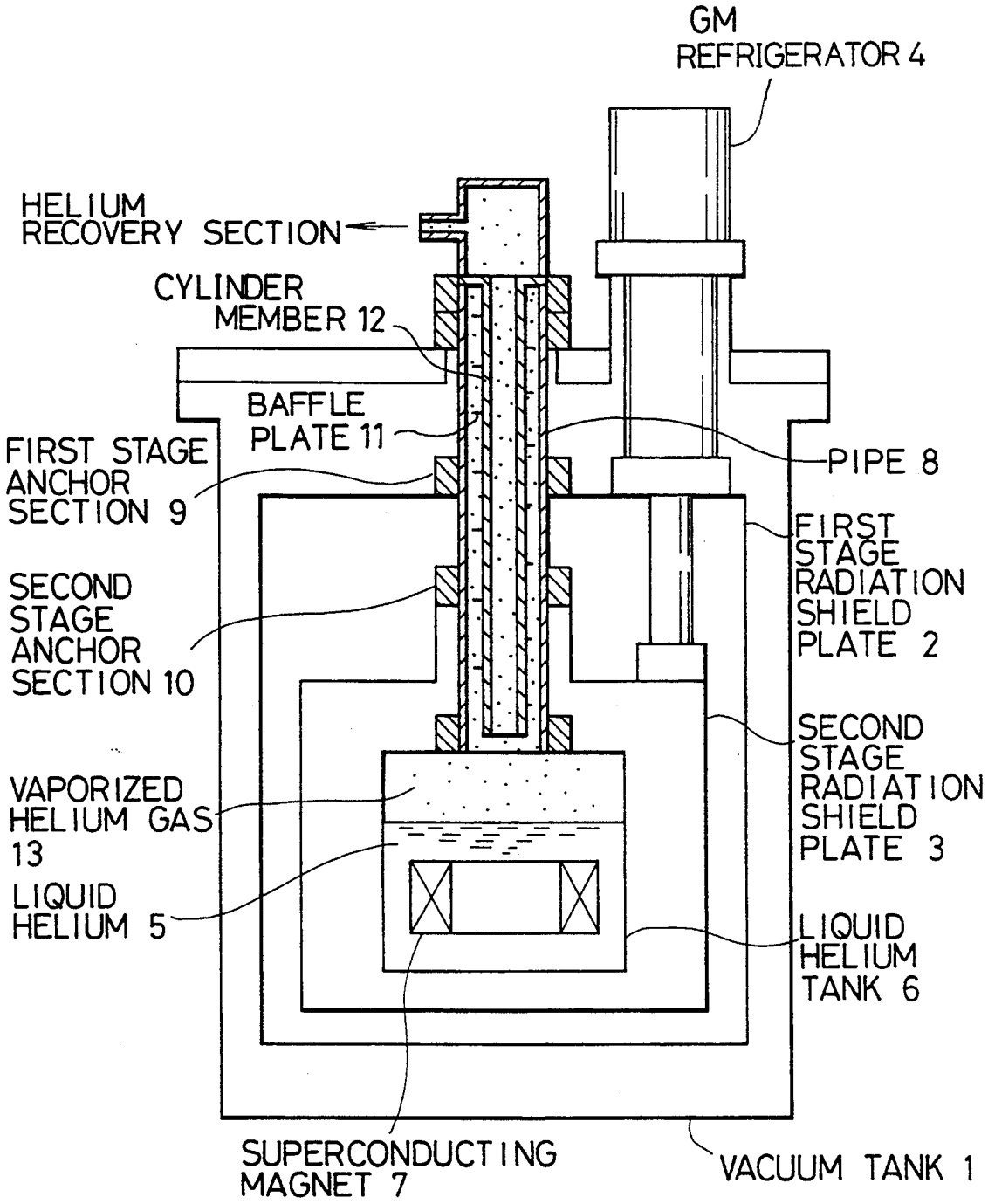
FIG. 10 is a schematic cross-sectional view showing a conventional cryostat.
Figure 11A:
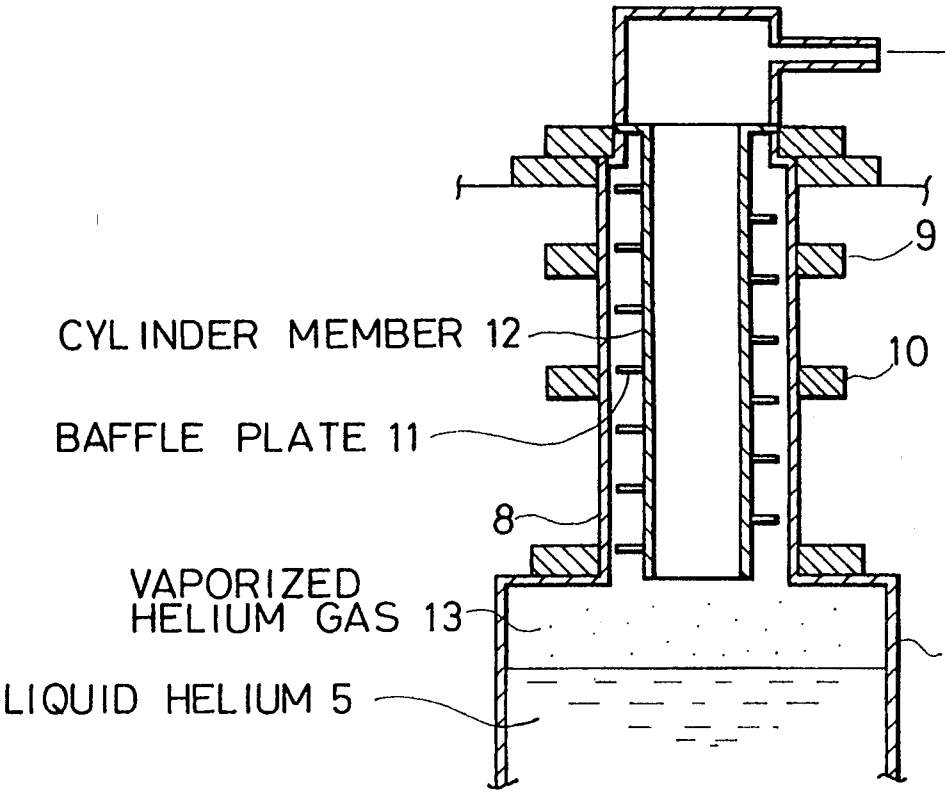
FIG. 11A is a schematic cross-sectional view showing a pipe of the conventional cryostat shown in FIG. 8.
Figure 11B:
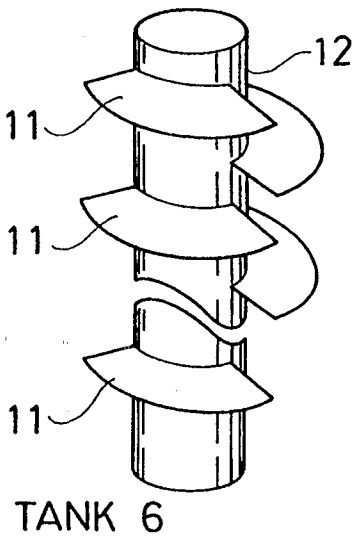
FIG. 11B is a view showing cylinder member 12 with a plurality of baffle plates 11.
Figure 12:
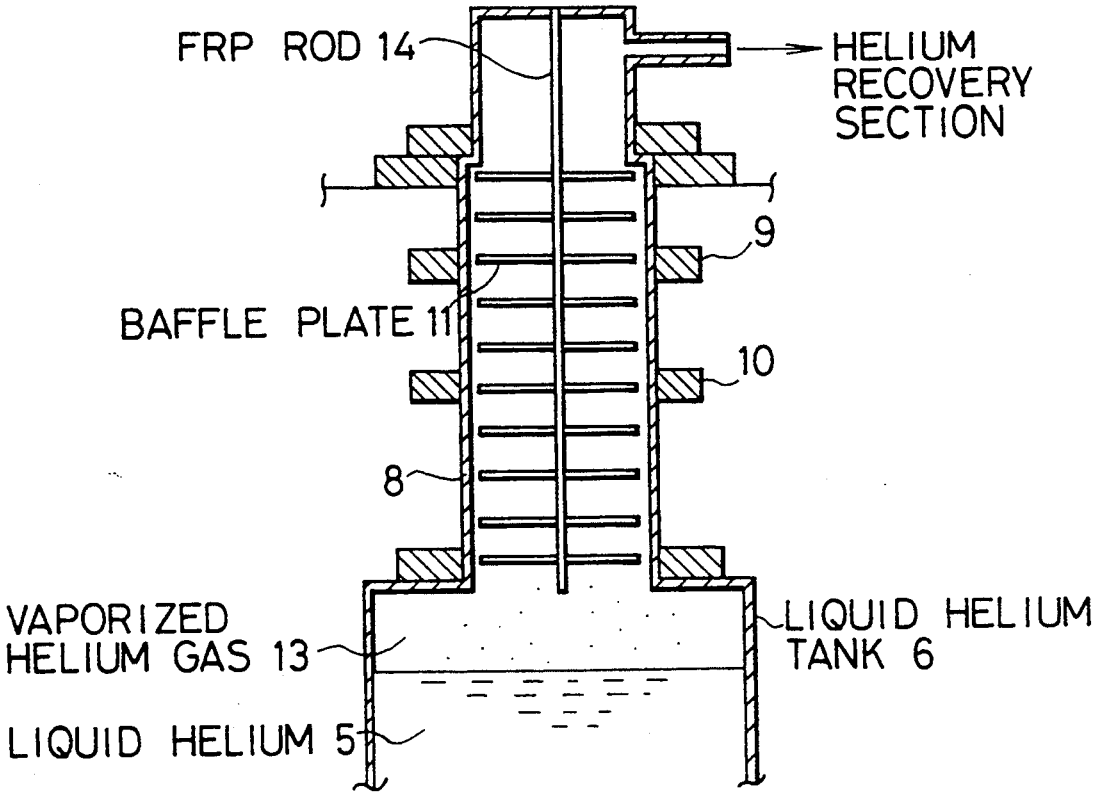
FIG. 12 is a schematic cross-sectional view showing a pipe of another embodiment of a conventional cryostat.

FIG. 8 is a graph showing the measured results of the amount of heat penetration into the liquid helium tank 6 of the cryostat using the pipe 8 in the first and second embodiments of the present invention. As shown in the drawing, in the case of the pipe 8 of the conventional cryostat shown in FIG. 10 (A in the drawing), the amount of heat penetration to the liquid helium tank 6 is about 9.3 mW (with the temperature of the second stage anchor section 10K at 7.3K), and for the present invention (for example, in the case of the insertion plate 15 (B in the drawing), fabricated from MLI (multi-laminated insulating material) inserted into the cylinder member 12 in the first embodiment) the amount of heat penetration to the liquid helium tank 6 is about 1.5 mW (with the temperature of the second stage anchor section 10 at 7.3!K) or about 1/6 of the amount of heat penetration in the conventional cryostat.

The greatest reduction in the amount of heat penetration to the liquid helium tank 6 is exhibited in the case of the insertion plate 19 (C in the drawing) formed by mounting a plurality of layers of MLI (multi-laminated insulating material) 18 on the circular FRP plate 17 in the pipe 8 of the second embodiment.

With this configuration, the amount of heat penetration to the liquid helium tank 6 is about 0.79 mW (with the temperature of the second stage anchor section 10K at 6.8K), or about 1/12 of the amount of heat penetration in the conventional cryostat. D and E in the drawing illustrate the amount of heat penetration when the insertion plate 15 inserted into the pipe 8 in the first embodiment is made of FRP and aluminum, respectively. Almost the same results are obtained in the third and fourth embodiments as in the first embodiment, but these results have been omitted from the drawing.

Also, in each of the above-mentioned embodiments, the insertion plates 15, 19, 21, 22 which are inserted into the pipe 8 are positioned at a point approximately intermediate between the first stage anchor section 9 and the second stage anchor section 10. In addition, as shown in FIG. 3, it can be obtain the same effect where the insertion plates 15, 19, 21, and 22 are set in a positions which are slightly shifted from the position intermediate between the first stage anchor section 9 and the second stage anchor section 10.

In addition, a plurality of insertion plates can be provided in one pipe 8 to obtain the same effect.

Figure 9:
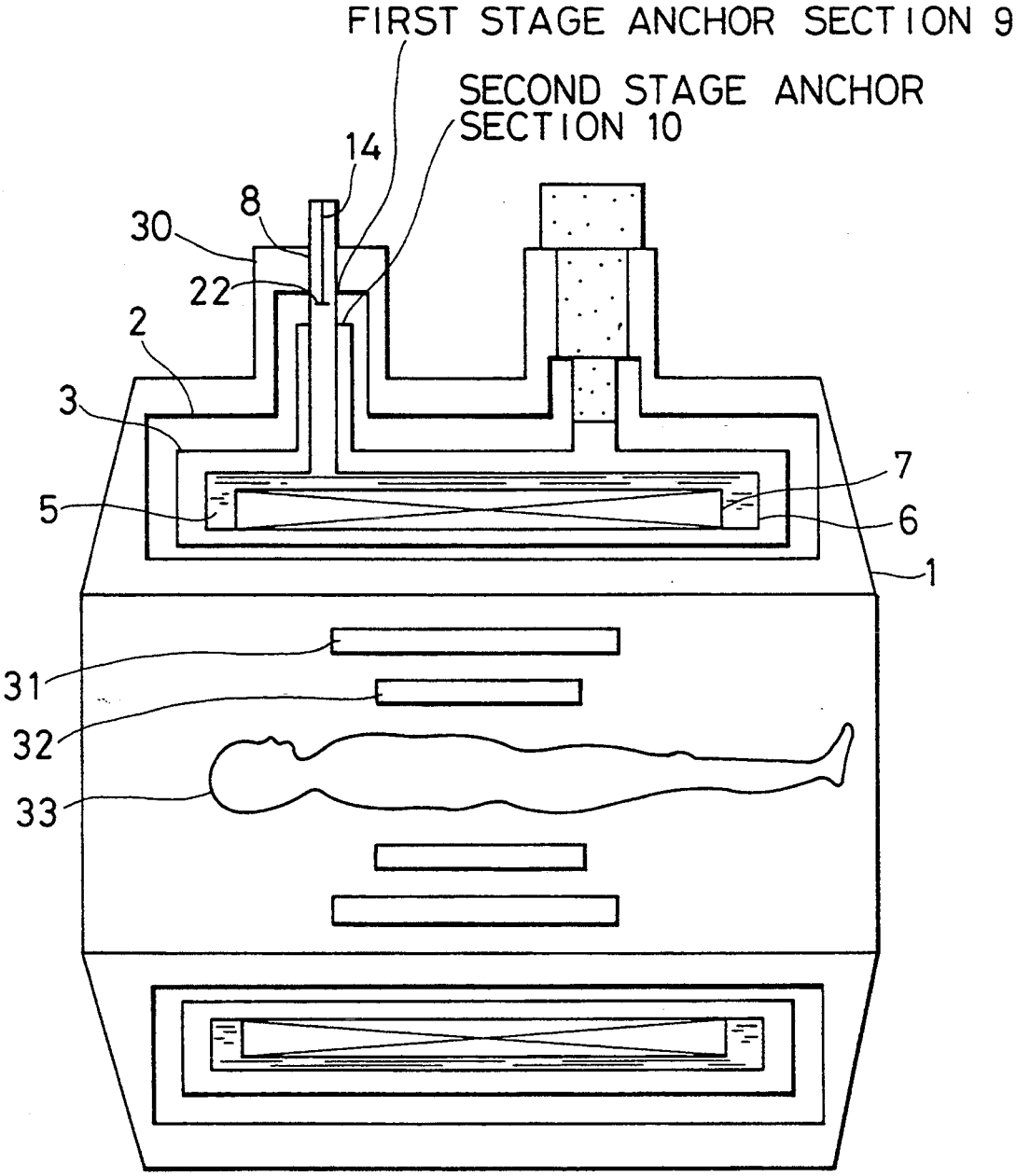
FIG. 9 is a schematic configuration drawing showing an MRI device using a cryostat of the present invention.

FIG. 9 is a schematic cross-sectional view showing an MRI (magnetic resonance imaging) device to which the cryostat of the present invention has been applied (in the drawing, a cryostat with a pipe 8 of the structure shown in the fourth embodiment).

In the MRI device shown in FIG. 9, the cryostat 30 of the present invention (in the drawing, a cryostat with a pipe 8 of the structure shown in the fourth embodiment) is arranged on the upper section of the cylindrical vacuum tank 1, and a gradient magnetic field coil 31 and a radio probe 32 for receiving and transmitting radio wave signals are arranged on the inner periphery of the superconductive magnet 7 (static field magnet).

The structure of the cryostat 30 was explained for the previously-described embodiment and will therefore be omitted here. The structure of the MRI device has been previously described. A human body 33 is placed in the static magnetic field generated by the superconducting magnet 7 and line-shaped gradient magnetic fields generated by the gradient magnetic field coil 31 are superimposed on the human body 33. Then, a NMR (nuclear magnetic resonance) signal (an electromagnetic wave released during resonant absorption of electromagnetic wave energy of a specified wave-length by certain atomic nuclei in a magnetic field), generated when a high frequency pulse from the radio probe 32 is applied, is once again detected by the radio probe 32, and a cross-sectional image of the desired portion of the human body 33 can be obtained by an imaging process involving restructuring, using a computer process.

The superconducting magnet 7 is used with the MRI device because a strong magnetic field (for example 0.2 T or greater) of high uniformity and stability extending across a wide static magnetic field is required.

The superconducting magnet 7 is maintained in a superconductive state by the liquid helium 5 in the liquid helium tank 6 of the cryostat 30 of the present invention.

Then, as described above for the embodiments of the present invention, by means of the insertion plate 22 inserted into the pipe 8 which connects the helium recovery section (omitted from the drawing) to the liquid helium tank 6, it is possible to greatly reduce the penetration of heat into the liquid helium tank 6 so that the amount of the liquid helium 5 lost by evaporation is greatly reduced, providing a reduction in maintenance costs.

It is possible to greatly reduce the penetration of heat to the liquid helium storage tank so that evaporation of the liquid gas is very small, therefore only a small amount of liquid gas must be replenished, with a saving in maintenance costs, as outlined in the foregoing specific explanation based on the embodiments.

What is claimed is:

1. A cryostat housing an ultra-low temperature medium, comprising:
   - a container for storing the ultra-low temperature medium;
   - a pipe connecting first and second sections of the container;
   - at least one tubular member interposedly arranged inside the pipe;
   - a heat anchor section for cooling the pipe; and
   - a plate-shaped member positioned inside the tubular member so that a gas layer of the ultra-low temperature medium inside the tubular member is divided along a longitudinal length of the tubular member.

2. A cryostat according to claim 1, wherein the heat anchor section includes at least first and second heat anchor sections separated a specific distance along the longitudinal length of the pipe, and the plate-shaped member is positioned between the first and second heat anchor sections.

3. A cryostat according to claim 2, wherein the plate-shaped member is positioned approximately at a midpoint between the first and second heat anchor sections.

4. A cryostat according to claim 1, further including a plurality of baffle plates positioned in an opening defined between an outer wall of the tubular member and an inner wall of the pipe.

5. A cryostat according to claim 4, wherein the plate-shaped member is positioned between the baffle plates.

6. A cryostat according to claim 1, wherein the plate-shaped member is formed as a lamination of a plurality of thin-plate members.

7. A cryostat according to claim 6, wherein the thin-plate members are made of an insulating material.

8. A cryostat according to claim 1, wherein the plate-shaped member is contained in a concave container which houses the plurality of thin-plate members.

9. A cryostat according to claim 1, wherein the plate-shaped member is a plurality of layers.

10. A cryostat according to claim 1, wherein the plate-shaped member is made of at least one type of material selected from a group including FRP, aluminum plate, MLI, and stainless steel.

11. A cryostat according to claim 1, wherein the plate-shaped member is freely removably positioned within the tubular member.

12. A cryostat housing an ultra-low temperature medium, comprising:

a container for storing the ultra-low temperature medium;

a pipe connecting first and second sections of the container;

first and second heat anchor sections disposed a distance along a longitudinal direction of the pipe, the first and second heat anchor sections cooling the pipe; and a substantially plate-shaped member disposed in the pipe between the first and the second heat anchor sections so that a gas layer of the ultra-low temperature medium is divided in the pipe along the longitudinal direction of the pipe.

13. A cryostat according to claim 12, wherein the plate-shaped member is disposed in a position corresponding to approximately a midpoint between the first and second heat anchor sections.

14. A cryostat according to claim 12, wherein the plate-shaped member is formed as a lamination of a plurality of thin-plate members.

15. A cryostat according to claim 14, wherein the thin-plate members are made of an insulating material.

16. A cryostat according to claim 15, wherein the plate-shaped member is contained in a concave container which houses the plurality of thin-plate members.

17. A cryostat according to claim 12, wherein the plate-shaped member is made of at least one type of material selected from a group including FRP, aluminum plate, MLI, and stainless steel.

18. A cryostat according to claim 12, wherein the plate-shaped member is freely insertable and removable with respect to the tubular member.

19. A cryostat according to claim 12, further including at least one tubular member interposedly arranged inside the pipe, wherein the plate-shaped member is positioned inside the tubular member so that it divides a gas layer of the ultra-low temperature medium inside the tubular member along the longitudinal direction of the pipe.

20. A cryostat according to claim 19, further including a plurality of baffle plates positioned in an opening defined between an outer wall of the tubular member and an inner wall of the pipe.

21. A cryostat according to claim 20, wherein the plate-shaped member is disposed about halfway between at least two of the baffle plates.

22. A cryostat housing an ultra-low temperature medium, comprising:

a container for storing the ultra-low temperature medium;

a pipe connecting first and second sections of the container;

a heat anchor section for cooling the pipe; and a plate-shaped member formed from multilayers of insulating material positioned inside the pipe so that a gas layer of the ultra-low temperature medium inside the pipe is divided along a longitudinal length of the pipe.

23. A cryostat according to claim 22, wherein the heat anchor section includes at least first and second heat anchor sections separated a specific distance along the longitudinal length of the pipe, and the plate-shaped member is positioned approximately halfway between the first and second heat anchor sections.

24. A cryostat according to claim 22, wherein the plate-shaped member is contained in a concave container which houses the multilayers.

25. A cryostat according to claim 22, wherein the plate-shaped member is freely insertable and removable with respect to the pipe.

26. A cryostat according to claim 22, further including at least one tubular member interposedly arranged inside the pipe, and wherein the plate-shaped member is positioned inside the tubular member so that it divides the gas layer of the ultra-low temperature medium inside the tubular member along the longitudinal length of the pipe.

27. A cryostat according to claim 26, further including a plurality of baffle plates positioned in an opening defined between an outer wall of the tubular member and an inner wall of the pipe.

28. A cryostat according to claim 27, wherein the plate-shaped member is placed approximately halfway between at least two of the baffle plates.

* * * * *